US007013999B2

(12) United States Patent
Tufts

(10) Patent No.: US 7,013,999 B2
(45) Date of Patent: Mar. 21, 2006

(54) WEDGE TOOTH CUTTER ELEMENT FOR DRILL BIT

(75) Inventor: John Tufts, Conroe, TX (US)

(73) Assignee: Smith International, Inc., Houston, TX (US)

( * ) Notice: Subject to any disclaimer, the term of this patent is extended or adjusted under 35 U.S.C. 154(b) by 109 days.

(21) Appl. No.: 10/628,191

(22) Filed: Jul. 28, 2003

(65) Prior Publication Data

US 2005/0023043 A1 Feb. 3, 2005

(51) Int. Cl.
*E21B 10/56* (2006.01)

(52) U.S. Cl. ..... 175/430; 175/377; 175/431

(58) Field of Classification Search ..... 175/331, 175/377, 378, 425, 426, 430, 431, 420.1
See application file for complete search history.

(56) References Cited

U.S. PATENT DOCUMENTS

| | | | | |
|---|---|---|---|---|
| 4,058,177 A | * | 11/1977 | Langford et al. | 175/374 |
| 4,086,973 A | | 5/1978 | Keller et al. | 175/374 |
| 4,108,260 A | | 8/1978 | Bozarth | 175/374 |
| 4,334,586 A | | 6/1982 | Schumacher | 175/374 |
| 4,832,139 A | | 5/1989 | Minikus et al. | 175/374 |
| 5,172,777 A | * | 12/1992 | Siracki et al. | 175/374 |
| 5,322,138 A | | 6/1994 | Siracki | 175/374 |
| 5,415,244 A | | 5/1995 | Portwood | 175/374 |
| 5,697,462 A | | 12/1997 | Grimes et al. | 175/374 |
| 5,813,485 A | | 9/1998 | Portwood | 175/430 |
| 5,915,486 A | | 6/1999 | Portwood et al. | 175/374 |
| 6,059,054 A | | 5/2000 | Portwood et al. | 175/430 |
| 6,241,034 B1 | | 6/2001 | Steinke et al. | 175/331 |
| 6,367,568 B1 | * | 4/2002 | Steinke et al. | 175/331 |
| 6,561,293 B1 | * | 5/2003 | Minikus et al. | 175/420.1 |
| 6,782,959 B1 | * | 8/2004 | Minikus et al. | 175/420.1 |

FOREIGN PATENT DOCUMENTS

EP 0527506 A2 8/1992

OTHER PUBLICATIONS

Search Report for Application No. GB0416617.9, dated Sep. 9, 2004 (3 p.).

* cited by examiner

*Primary Examiner*—Jennifer H Gay
(74) *Attorney, Agent, or Firm*—Conley Rose, P.C.

(57) ABSTRACT

A cutter element for a rolling cone bit includes a cutting surface having front and back surfaces, a pair of flanking surfaces that intersect in a rounded nose that is offset from the central axis of the cutter element's base. At least one flanking surface includes a concave region. The back surface presents a generally wedge-shaped top profile.

36 Claims, 8 Drawing Sheets

WEDGE TOOTH CUTTER ELEMENT FOR DRILL BIT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates generally to earth boring bits used to drill a borehole for the ultimate recovery of oil, gas, or minerals. More particularly, the invention relates to rolling cone rock bits and to an improved cutting structure and cutter elements for such bits. Still more particularly, the invention relates to enhancements in cutter element shape, positioning and orientation in the drill bit.

2. Description of the Related Art

An earth-boring drill bit is typically mounted on the lower end of a drill string and is rotated by revolving the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

A typical earth-boring bit includes one or more rotatable cone cutters that perform their cutting function due to the rolling movement of the cone cutters acting against the formation material. The cone cutters roll and slide upon the bottom of the borehole as the bit is rotated, the cone cutters thereby engaging and disintegrating the formation material in its path. The rotatable cone cutters may be described as generally conical in shape and are therefore referred to as rolling cones.

Rolling cone bits typically include a bit body with a plurality of journal segment legs. The rolling cones are mounted on bearing pin shafts that extend downwardly and inwardly from the journal segment legs. The borehole is formed as the gouging and scraping or crushing and chipping action of the rotary cones remove chips of formation material which are carried upward and out of the borehole by drilling fluid which is pumped downwardly through the drill pipe and out of the bit.

The earth disintegrating action of the cone cutters is enhanced by providing the cone cutters with a plurality of cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits, while those having teeth formed from the cone material are commonly known as "steel tooth bits." In each instance, the cutter elements on the rotating cone cutters breakup the formation to form new borehole by a combination of gouging and scraping or chipping and crushing.

In oil and gas drilling, the cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipes, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer and which are usable over a wider range of formation hardness.

The length of time that a drill bit may be employed before it must be changed depends upon its ability to "hold gage" (meaning its ability to maintain a full gage borehole diameter), its rate of penetration ("ROP"), as well as its durability or ability to maintain an acceptable ROP. The form and positioning of the cutter elements (both steel teeth and tungsten carbide inserts) upon the cone cutters greatly impact bit durability and ROP and thus, are critical to the success of a particular bit design.

The inserts in TCI bits are typically inserted in circumferential rows on the rolling cone cutters. Most such bits include a row of inserts in the heel surface of the cone cutters. The heel surface is a generally frustoconical surface and is configured and positioned so as to align generally with and ream the sidewall of the borehole as the bit rotates.

In addition to the heel row inserts, conventional bits typically include a circumferential gage row of cutter elements mounted adjacent to the heel surface but oriented and sized so as to cut the corner of the borehole. In performing their corner cutting duty, gage row inserts perform a reaming function, as a portion of the insert scraps or reams the side of the borehole, and also perform bottom hole cutting, a duty in which the gouges the formation material at the bottom of the borehole. This dual function of a gage row insert many times leads to design compromises for such insert.

Conventional bits also include a number of additional rows of cutter elements that are located on the cones in circumferential rows disposed radially inward or in board from the gage row. These cutter elements are sized and configured for cutting the bottom of the borehole, and are typically described as inner row cutter elements.

Earthen formations generally undergo two types of fractures when penetrated by a cutter element that protrudes from a rolling cone of a drill bit. A first type of fracture is generally referred to as a plastic fracture, and is the type of fracture where the cutter element penetrates into the rock and volumetrically displaces the rock by compressing it. This type of fracture generally creates a crater in the rock that is the size and shape of that portion of the cutter element that has penetrated into the rock.

A second principal type of fracture is what is referred to as a brittle fracture. A brittle fracture typically occurs after a plastic fracture has first taken place. That is, when the rock first undergoes plastic fracture, a region around the crater made by the cutter element will experience increased stress and will weaken and may crack in that region, even though the rock in that region surrounding the crater has not been displaced. This region of increased stress is generally recognized as the "Hertzian" contact zone. However, in certain formations, when the cutter element displaces enough of the rock and creates enough stress in the Hertzian contact zone adjacent to the plastic fracture, that rock in the region of increased stress may itself break and chip away from the crater. Where this occurs, the cutter element effectively removes a volume of rock that is larger than the volume of rock displaced in the plastic fracture. The characteristics of these fractures depend largely on the geometry of the cutter element and the properties of the rock that is being penetrated.

Because a brittle fracture removes more rock material than a plastic fracture, it would be advantageous to provide a cutter element suitable for inducing brittle fractures that would perform that function without requiring increased force or weight on bit. Thus, to increase a bit's rate of penetration (ROP), it is desirable to increase the bit's ability to initiate brittle fractures at the locations where the cutter element engages the formation material so that the volume of rock removed by each hit or impact of the cutter element is greater than the volume of rock actually penetrated by the cutter element.

A variety of different shapes of cutter elements have been devised. In most instances, each cutter element is designed to optimize the amount of formation material that is removed with each "hit" of the formation by the cutter element. At the same time, however, the shape and design of a particular cutter element is also dependent upon the location in the drill bit in which it is to be placed, and thus the cutting duty to be performed by that cutter element. For example, in general, heel row cutter elements are generally made of a harder and more wear resistant material, and have a less aggressive cutting shape for reaming the borehole side wall, as compared to the inner row cutter elements where the cutting duty is more of a gouging, digging and crushing action. Thus, in general, bottom hole cutter elements generally tend to have more aggressive cutting shapes than heel row cutters.

It is understood that cutter elements, depending upon their location in the rolling cone cutter, have different cutting trajectories as the cone cutter rotates in the borehole. Thus, conventional cutter elements have been oriented in the rolling cone cutters in a direction believed to cause optimal formation removal. However, it is now understood that cutter elements located in certain portions of the cone cutter have more than one cutting mode. More particularly, cutter elements in the inner rows of the cone cutters, particularly those closest to the nose of the cone cutter (and the center line of the bit), include a twisting motion as they gouge into and then separate from the formation. Unfortunately, however, conventional cutter elements, such as a chisel shaped insert, having a single primary cutting edge, are usually oriented to optimize the cutting that takes place only in the cutter's circumferential cutting trajectory, as the do not have particular features to take advantage of cutting opportunities as the cutter element twists.

Accordingly, to provide a drill bit with higher ROP, and thus to lower drilling costs incurred in the recovery of oil and other valuable resources, it would be desirable to provide cutter elements designed and oriented so as to enhance brittle fracture of the rock formation being drilled.

SUMMARY OF THE PREFERRED EMBODIMENTS OF THE INVENTION

Described herein is cutter element for use in a rolling cone drill bit particularly, but not exclusively, suited for drilling in relatively hard formations. In one preferred embodiment, the cutter element includes a base portion retained in the rolling cone, and a cutting surface that extends from the cone surfaces that includes a front surface, a back surface, a pair of flanking surfaces, and converge together to form a nose. Preferably, the nose is spaced from the central axis of the cutter element base. One or both of the flanking surfaces is formed to include a concave region. In this embodiment, the back surface slopes down and away from a leading end at the nose to a trailing end opposite the nose. The back surface is generally wider adjacent to the trailing end than at the leading end, such that the back is generally wedge shaped as viewed from above. In this manner, the convergence of the back surface, flanking surfaces, and nose forms a generally wedge-shaped top cutting profile and, preferably, a wedge-shaped side profile. The shape of the cutting surface provides a relatively sharp front edge allowing the cutter initially to penetrate deeply into the formation before the wider portions of the cutting surface act on the formation so as to create a large brittle fracture.

In certain embodiments of the invention, the top cutting profile may be pear-shaped or triangular shaped. Furthermore, the nose portion of the cutting surface may extend all the way to the outer profile of the cutter element base, or may be offset or, in a more aggressive cutting structure, may extend beyond the outer profile by an extension length E.

In certain embodiments, it is preferred that the nose of the cutting surface have a radius R that is at least about ten percent of the diameter of the base. In certain embodiments, the nose has a spherical radius. Also, in certain embodiments, it is desirable that the wider portion of the top cutting profile and back surface be at least three times larger than the width at the nose and, even more preferably, at least five times larger.

The various embodiments of the cutter element may be employed in the inner rows of a rolling cone cutter to enhance removal of the bottom hole formation material. In other embodiments, the cutter elements described herein may be advantageously employed in a gage row.

Thus, the embodiments described herein comprise a combination of features and advantages which overcome some of the shortcomings of prior bits and cutter element designs. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF PREFERRED EMBODIMENTS

Figure 1:
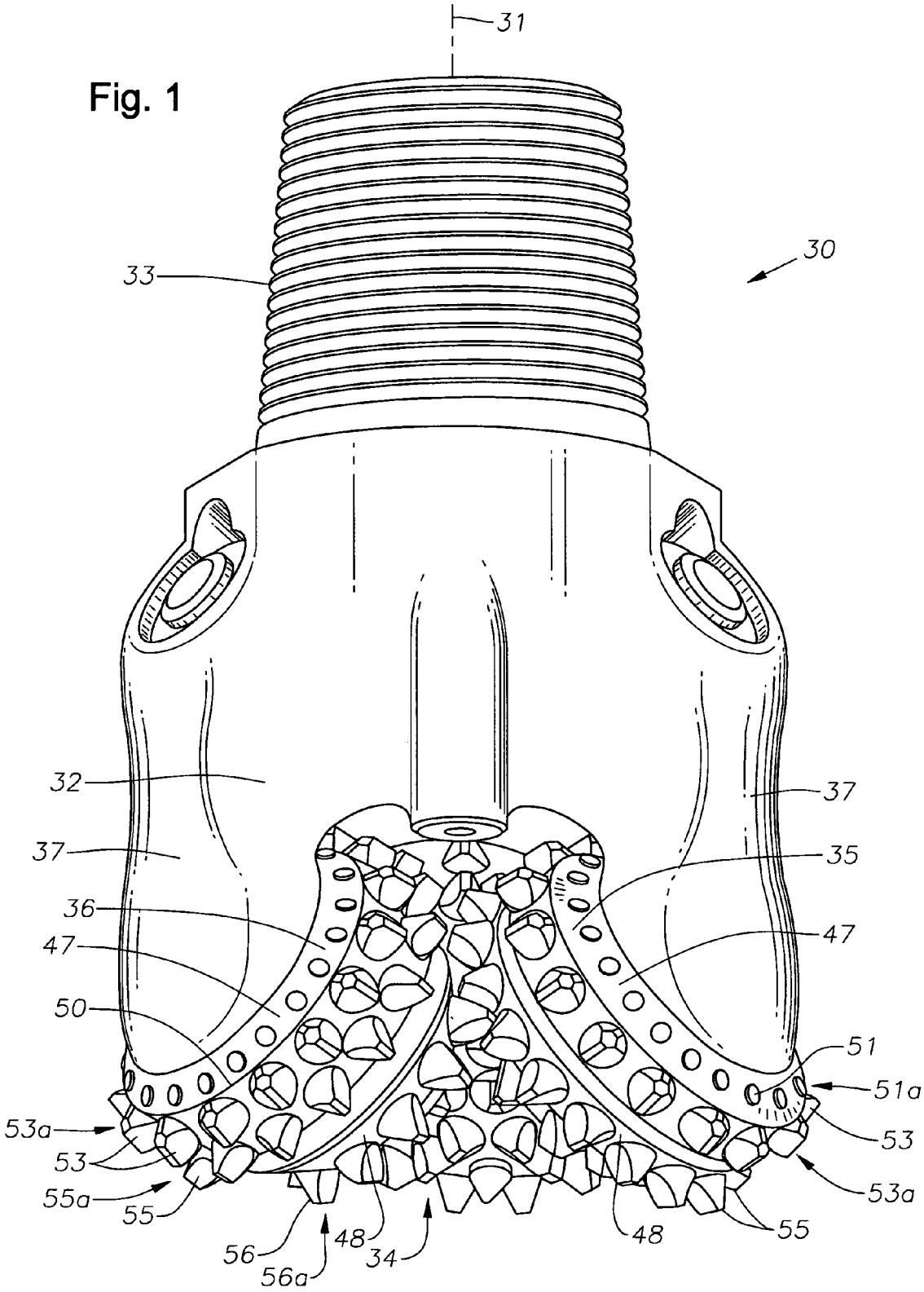
FIG. 1 is a perspective view of an earth boring bit.

Referring first to FIG. 1, an earth-boring bit 30 includes a central axis 31 and a bit body 32 having a threaded section 33 on its upper end for securing the bit to the drill string (not shown). Bit 30 has a predetermined gage diameter as defined by three rolling cone cutters 34, 35, 36 rotatably mounted on bearing shafts (not shown) that depend from the bit body 32. The present invention will be understood with a detailed description of one such cone cutter 34, with cones 35, 36 being similarly—although not necessarily identically—configured. Bit body 32 is composed of three sections, or legs 37 (two shown in FIG. 1), that are joined together to form bit body 32.

Figure 2:
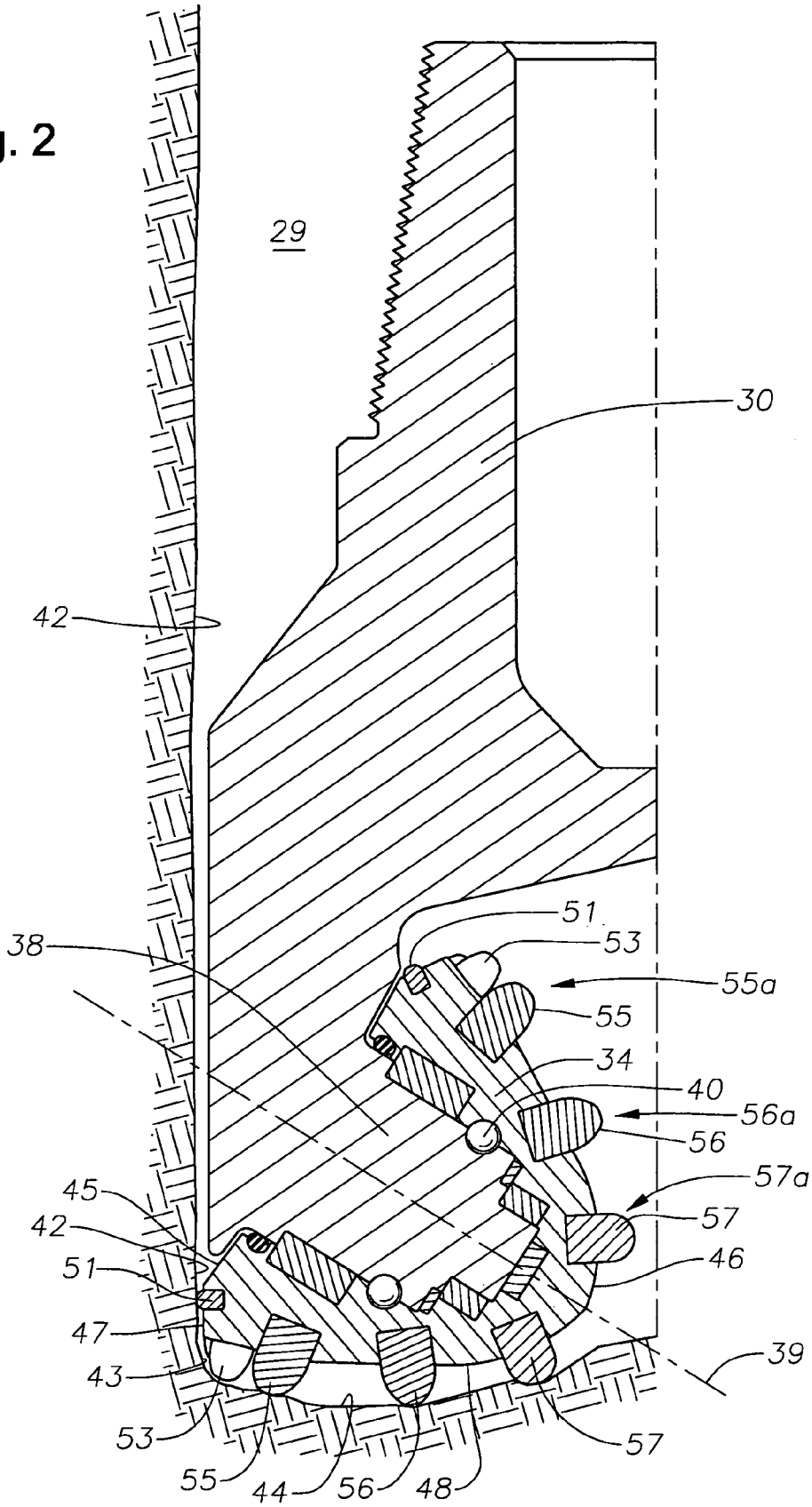
FIG. 2 is a partial section view taken through one leg and one rolling cone cutter of the bit shown in FIG. 1.

Referring now to FIG. 2, a sectioned view of bit 30 is shown inside a borehole 29 that includes sidewall 42, corner portion 43, and bottom 44. Cone cutter 34 is rotatably mounted on a pin or journal 38, with the cone's axis of rotation 39 oriented generally downward and inward towards the center of bit 30. Cone cutter 34 is secured on pin 38 by locking balls 40.

Referring to FIGS. 1 and 2, each cone cutter 34–36 includes a backface 45 and nose portion 46 generally opposite backface 45. Cutters 34–36 further includes a frustoconical heel surface 47. Frustoconical surface 47 is referred to herein as the "heel" surface of cutters 34–36. It being understood, however, that the same surface may sometimes be referred to by others in the art as the "gage" surface of a rolling cone cutter. Extending between heel surface 47 and nose 46 is a generally conical surface 48 adapted for supporting cutter elements which gouge or crush the borehole bottom 44 as the cone cutters 34–36 rotate about the borehole. Frustoconical heel surface 47 and conical surface 48 converge in a circumferential edge or shoulder 50, as shown in FIG. 1.

Cone cutters 34–36 include a plurality of tooth-like cutter elements for gouging, scraping and chipping away the surfaces of the borehole. The cutter elements retained in cone cutter 34 include a plurality of heel row inserts 51 that are secured in a circumferential row 51*a* in the frustoconical heel surface 47. Cone cutter 34 further includes a circumferential row 53*a* of gage inserts 53 secured to cone cutter 34 in locations along or near the circumferential shoulder 50. Cone cutter 34 also includes a plurality of inner row inserts, such as inserts 55, 56, 57 secured to the generally conical cone surface 48 and arranged in spaced-apart inner rows 55*a*, 56*a*, 57*a* respectively.

Referring again to FIG. 2, heel inserts 51 generally function to scrape or ream the borehole sidewall 42 to maintain the borehole at full gage and prevent erosion and abrasion of heel surface 47. Gage row cutter elements 53 cut the corner of the borehole and endure side wall and bottom hole forces as they perform their cutting duty. Inner row cutter elements 55–57 are employed primarily to gouge and crush and thereby remove formation material from the borehole bottom 44. Inner rows 55*a*, 56*a*, 57*a*, are arranged and spaced on cone cutter 34 so as not to interfere with the inner rows on each of the other cone cutters 35, 36.

Figure 3B:
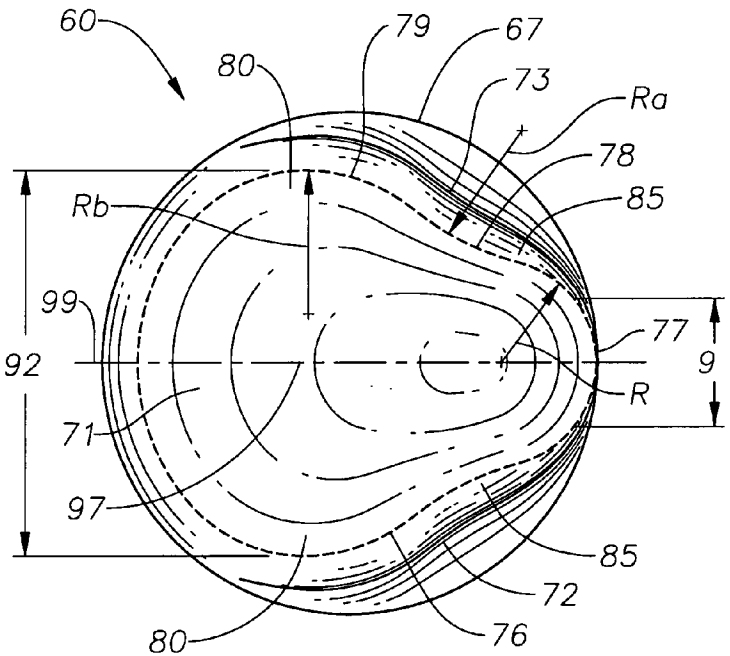
FIGS. 3A–3C are, respectively, side elevation, top view, and front elevation views of a first cutter element having particular application in a rolling cone bit such as that shown in FIGS. 1 and 2.
Figure 3A:
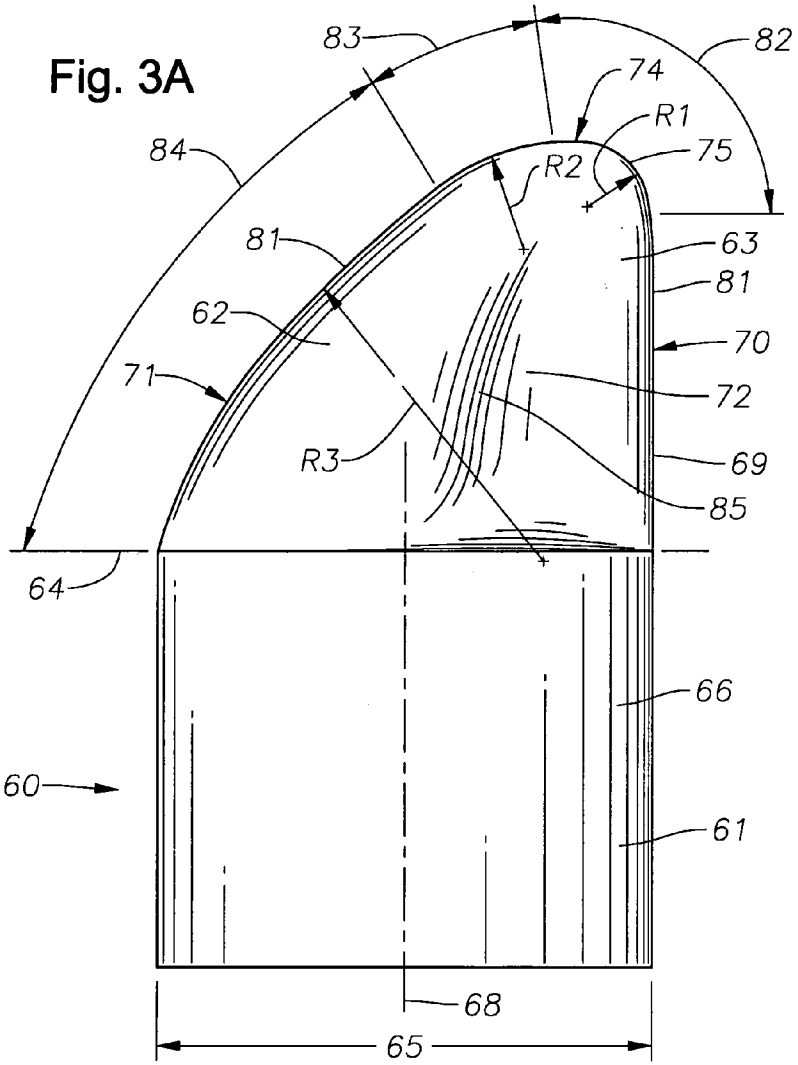
Figure 3C:
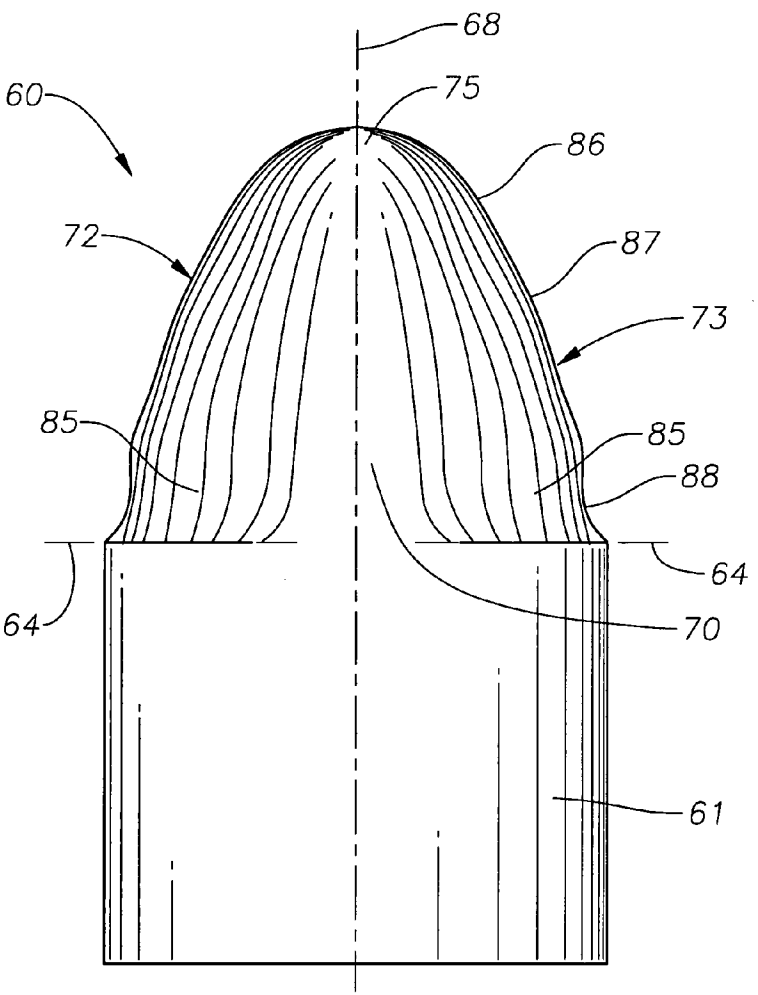

Referring to FIGS. 3A–3C, cutter element insert 60 is shown to include base portion 61, and cutting portion 62 extending therefrom in a side elevation view, top view and front view, respectively. Cutting portion 62 preferably includes a continuously contoured cutting surface 63 extending from the plane of intersection 64 between base 61 and cutting portion 62. In this embodiment, base portion 61 is generally cylindrical, having diameter 65, central axis 68, and an outer surface 66 defining an outer circular profile or footprint 67 of the insert (FIG. 3B). Base portion 61 may be formed in a variety of shapes other than cylindrical. As conventional in the art, base portion 61 is preferably retained within a rolling cone cutter by interference fit, or other means, such that cutting portion 62 extends beyond the cone steel.

As mentioned above, cutting surface 63 is preferably a continuously contoured surface. As used herein, the term "continuously contoured" means and refers to surfaces that can be described as having continuously curved surfaces that are free of relatively small radii (typically less than 0.08 inches) that are conventionally used to break sharp edges or round off transitions between adjacent distinct surfaces. By eliminating small radii along cutting surface 63, stresses in the cutting surface are substantially reduced leading to a more durable and longer lasting cutter element.

Continuously contoured cutting surface 63 generally includes a front or leading surface 70, a trailing or back surface 71 and a pair of flanking surfaces 72, 73. Surfaces 70–73 extend from base 61 and intersect to form a cutting tip shown generally at 74. The forward most portion of the cutting tip 74 includes nose 75. As shown, nose 75 is spaced forward of axis 68.

Referring now to FIG. 3A, cutting surface 63 also includes a wedge-shaped side profile 81. As shown, side profile 81 is defined, in part, by back surface 71 as it slopes down and away from nose 75 to base 61. As contrasted with certain conventional cutter elements having elongate crests (such as a conventional chisel insert, for example), back surface 71 continuously falls away from nose 75 toward base 61 such that side profile 81 is free of profile segments that extend parallel or substantially parallel to plane of intersection 64. Lacking such profile segments, cutting surface 63 may be defined as being "crestless." Side profile 81 includes a first segment 82 having radius $R_1$ at the nose 75 which is blended into a middle segment 83 having a radius $R_2$ that is greater than $R_1$. In turn, side profile 81 includes a trailing segment 84 having a radius $R_3$ that is greater than $R_2$. Profile segments 82, 83, 84 extend along crown line 97 (FIG. 3B). In this embodiment, the radius of curvature of cutting surface 63 at nose 75 is spherical, such that $R_1$=R. Front surface 70 provides the forward facing or front edge 69 of side profile 81 which is generally straight relative to the profile of base outer surface 66 from base 61 to nose 75.

Referring now to FIG. 3B, back surface 71 and its intersection with flanking surfaces 72, 73 and nose 75 provides a generally wedge-shaped top profile for cutting surface 63 represented by dashed line 76. In this embodiment, as viewed from the top, the top cutting profile 76 includes a radiused nose portion 77 having radius R. The radius R chosen for nose 75 is dependent on various factors, including formation hardness and cutter element size. If R is relatively small, the cutter element may be undesirably sharp for use in the harder formations typically drilled using TCI bits, thereby leading to increased cutter element stresses and, perhaps, premature breakage. Accordingly, in this embodiment, it is preferred that R be not less than about 10 percent of the diameter 65 of base 61. Adjacent to nose portion 77 along each flanking surface 72, 73, top profile 76 includes an inverted radiused, or concave, segment 78 having a radius $R_A$. Top profile 76 further includes an outwardly radiused, or convex, segment 79 having a radius $R_B$ and adjacent to inverted radius segment 78, segments 79 generally defining lobed portions 80 along flanking surfaces 72, 73. In this configuration, top cutting profile 76 is generally pear-shaped. Top profile 76 and back surface 71 are bisected by plane of symmetry 99 that passes through axis 68 and defines a crown line 97 where the plane intersects the curved and sloping back surface 71. In this embodiment, cutting surface 63 is symmetrical about plane 99.

The cutting surface 63 of insert 60 also defines a front profile 86, best shown in FIG. 3C. As shown in FIGS. 3B and 3C, front profile 86 and cutting surface 63 include an inverted radiused segment 88 adjacent to plane of intersection 64. Front profile 86 further includes an outwardly bowed segment 87 extending from nose 75 to the inverted radiused segment 88. Flanking surfaces 72, 73, of cutting surface 63 further include a recess or concave region 85 generally extending from near intersection 64 toward cutting tip 74. The elongate recess 85 extends at an angle generally directed away from axis 68 and toward nose 75, best shown in FIG. 3A. Referring to FIGS. 3B and 3C, providing a recessed region 85 in one or both of flanking surfaces 72, 73 provides a sharper cutting surface so as to allow the front end 70 of cutting surface 63 to penetrate deeper into the formation material before the portions 80 of top profile 76 engage and act against the formation. It should be understood, a recessed region 85 may be provided in only one flanking surface 72, 73. That is, although the cutter element shown and described with reference to FIGS. 3A–3C includes a symmetrical cutting surface 63, the cutting surface need not be symmetrical. For example, referring to FIG. 3B, depending upon the location of the insert and its orientation in the rolling cone cutter, it may be desirable to form the cutting surface so that the top cutting profile 76 includes radii for segments 78, 79 that differ from one side of the cutting profile to the other. As a further example, it may be desirable to provide an inverted radiused segment 78 on only one side of the cutter element with the corresponding segment on the opposite side being either generally straight or outwardly bowed.

Referring again to FIG. 3B, wedge-shaped top profile 76 is generally shown to have its smallest dimension at nose 75 and its widest dimension at a location generally aligned with lobes 80. In this embodiment, nose 75 generally has the width 91 that is defined as being about twice R. At its widest portion, top profile 76 has a width 92 that is substantially greater than the width 91 of nose 75. As described in more detail below, potential enhancements in formation removal are attributable, at least in part, to the wedge shape of back surface 71 and the top profile 76 and of side profile 81 of cutting surface 63. The term "wedge ratio" as used herein means the ratio of the width of a wedge-shaped profile at its widest portion as compared to the width of the profile at the nose. Thus, a cutter element having a top cutting profile with a wedge ratio of 5 to 1 means that the profile is five times wider at its widest portion than the width of the nose. To enhance insert 60's formation cutting capabilities, it is preferred that the widest portion 92 of top profile 76 be at least three times larger than the width 91 of nose portion 75. In the embodiment shown in FIGS. 3A–3C, the rear width 92 of top profile 76 is substantially equal to about six times R.

Cutter element 60 is believed to have particular utility in bottom hole cutting, and thus is useful when employed in inner rows 55*a*, 56*a*, and 57*a* as shown in FIGS. 1 and 2. When employed in such an inner row, to enhance the ability of insert 60 to create large brittle fractures of formation material, it is desirable that front surface 70 and nose 75 enter the formation first, to be followed by flanking surfaces 72, 73 and, lastly, by the portion of cutting surface 63 having lobes 80.

Figure 4A:
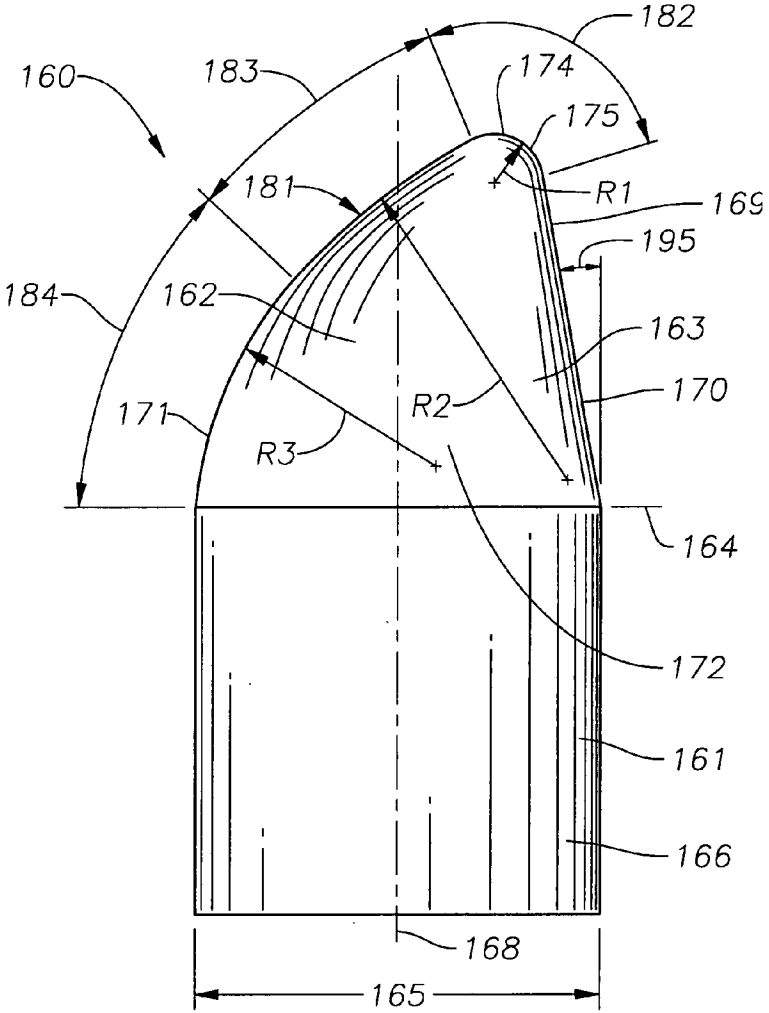
FIGS. 4A–4C are, respectively, side elevation, top view, and front elevation view of another cutter element useful in the drill bit of FIGS. 1 and 2.
Figure 4C:
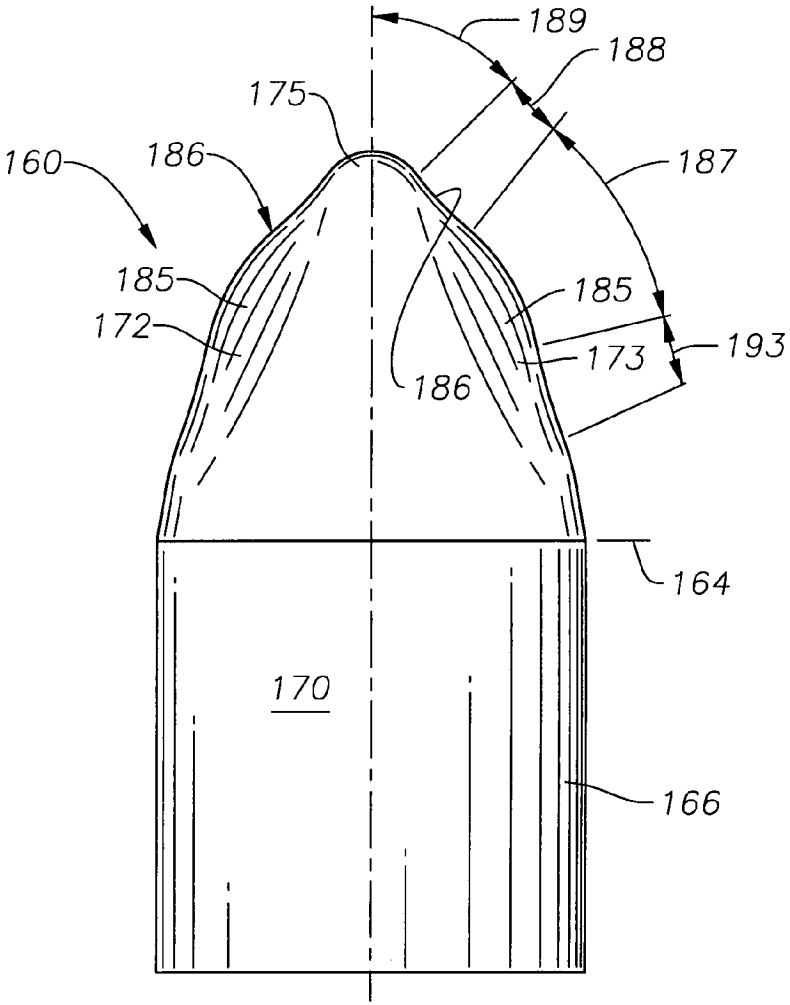
Figure 4B:
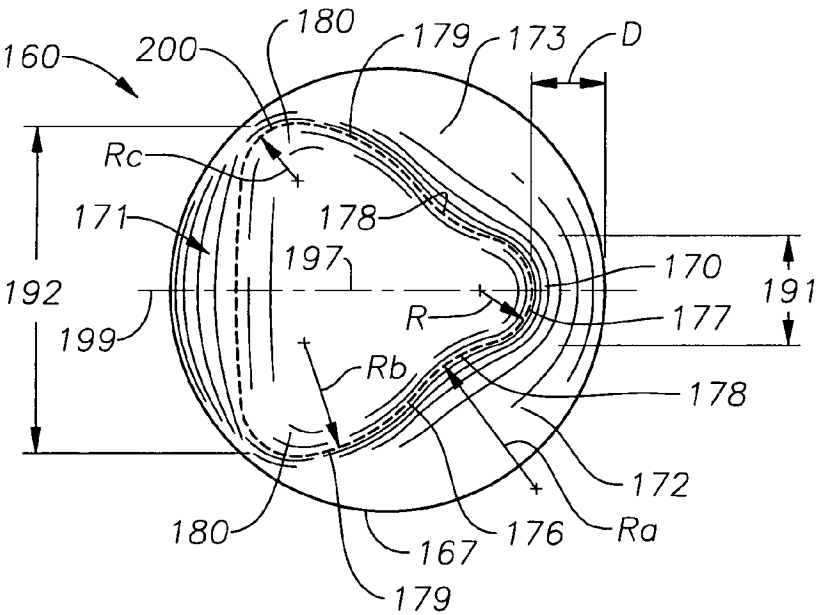

Another cutter element insert having a cutting surface with wedge-shaped side and top cutting profiles is shown in FIGS. 4A–4C in a side elevation view, top view and front view, respectively. As shown therein, cutter element insert 160 includes a base portion 161 and a cutting portion 162 that intersect at plane of intersection 164. Base portion 161 further includes a central axis 168. Cutting portion 162 preferably includes a continuously contoured cutting surface 163. Base 161 is generally cylindrical having diameter 165 and an outer surface 166 that defines the outer profile 167 (FIG. 4B).

Cutting surface 163 generally includes a front or leading surface 170, a trailing or back surface 171, and a pair of flanking surfaces 172, 173 which extend from base 161 and intersect so as to form cutting tip shown generally at 174. The forwardmost portion of the cutting tip 174 includes nose 175 which is spaced apart from axis 168.

As best shown in FIG. 4A, the side profile 181 of cutting surface 163 is generally wedge shaped and includes a forward or front edge 169 formed by front surface 170. Edge 169 is generally straight, but is angled from base 161 to nose 175 in a direction toward axis 168 thereby forming an angle of relief designated as 195. Side profile 181 is defined, in part, by back surface 171 that slopes down and away from nose 175 toward base 161. As the term is used herein, cutting surface 163 is crestless. Side profile 181 includes a radiused segment 182 having radius $R_1$ at the nose that is blended with a middle segment 183 having radius $R_2$, which is substantially larger than radius $R_1$. Side profile 181 further includes a trailing segment 184 having a radius $R_3$ that is less than $R_2$ but greater than $R_1$. As shown in FIG. 4A, profile segment 183 may be substantially straight. Profile segments 182–184 are aligned with crown line 197 (FIG. 4B).

Referring now to FIG. 4B, back surface 171 and its convergence with flanking surfaces 172, 173 and nose 175 defines a generally wedge-shaped top profile represented by dashed line 176. In this embodiment, top cutting profile 176 has a generally triangular shape. Top cutting profile 176 includes a radiused nose portion 177 having radius R. Adjacent to nose portion 177 on top profile 176 along each flanking surface 172, 173, is inverted radius, or concave, segment 178 having a radius $R_A$. Top profile 176 further includes an outwardly bowed, or convex, radiused segment 179 adjacent to segment 178 which defines lobed portions 180. Convex segment 179 adjacent to concave segment 178 has a radius $R_B$. Top profile 176 may also include a convex corner segment 200 adjacent to convex segment 179 and having a radius $R_C$, where $R_C$ is smaller than $R_B$. Top profile 176 includes its widest dimension 192 as defined by the outermost reaches of lobed portions 180. The widest dimension 192 of top profile 176 is preferably at least four times width 191 of nose 175. Top profile 176 and cutting surface 163 are bisected by and symmetrical about plane of symmetry 199. The intersection of plane 199 and curved back surface 171 defines crown line 197.

As a result of inclination angle 195, nose 175 is set back from the outer profile 167 of base 161 by a distance D (FIG. 4B). Nose 175 is preferably formed with a spherical radius R such that, in this embodiment, the width 191 of nose 175 is generally defined as two times R. Preferably, the setback of nose 75 is between about one and about three times R. In this embodiment too, R is substantially equal to $R_1$. Also, for durability, it is preferred that R be at least about 10 percent of the diameter 165 of base 161.

As best shown in FIG. 4C, cutting surface 163 defines a front profile 186. From nose 175 moving toward base 161, front cutting profile 186 includes a nose segment 189 having radius $R_1$, followed by an inverted radiused segment 188, followed by an outwardly bowed segment 187, which, in turn, is followed by an inverted radiused segment 193.

Preferably, each flanking surfaces 172, 173 of cutting surface 163 includes a concave region or recess 185 extending from near intersection 164 upwardly toward cutting tip 174. Providing concave regions 185 effectively sharpens the front surface 170 of the cutting surface 163 to allow deeper penetration of the cutter element before the wider section of the wedge-shaped cutting surfaces act upon the formation. Optionally, cutting surface 163 may be asymmetrical and formed so as to include recessed region 185 on only one flanking surface 172, 173.

The wedge-shaped top and side cutting profiles 176, 181 of cutting surface 163 described above provide cutter element 160 with the potential for removing formation material at a faster rate than conventional inserts, such as a conventional conical or standard chisel-shaped insert. In comparison to the insert 60 previously described, it is believed that insert 160 will have general application in formations that are relatively soft and where the rock is brittle in nature.

Figure 5A:
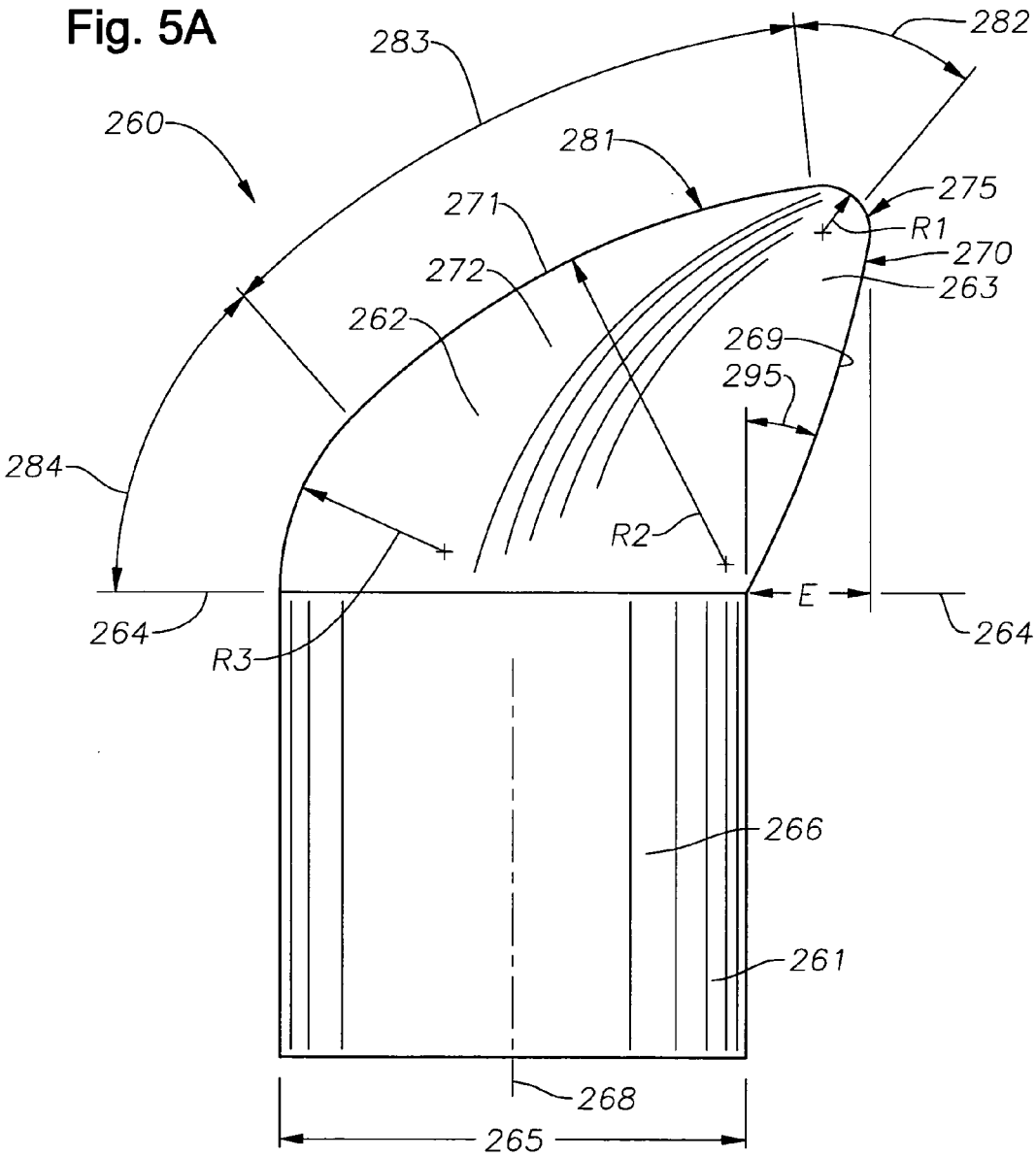
FIGS. 5A–5C are, respectively, side elevation, top view, and front elevation view of still another cutter element useful in the drill bit of FIGS. 1 and 2.
Figure 5B:
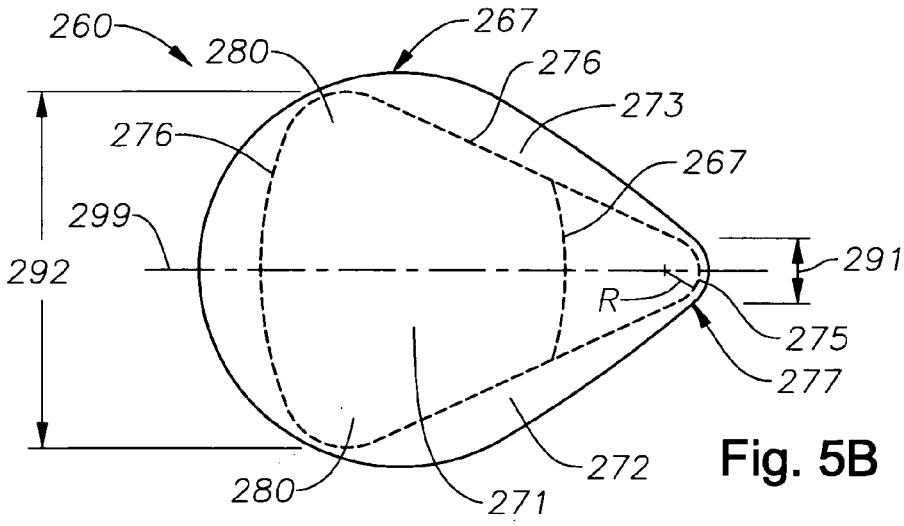
Figure 5C:
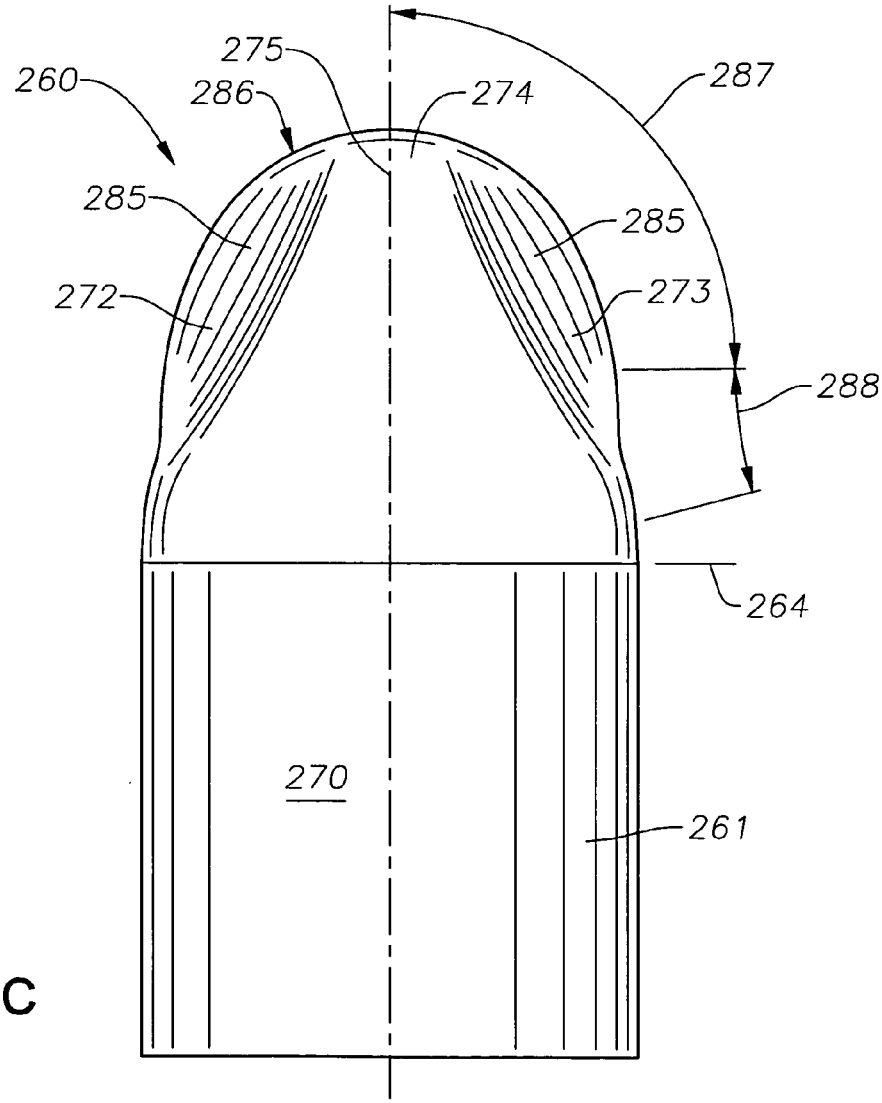

Another cutter element insert having a cutting surface with wedge-shaped side and top profiles is shown in FIG. 5A–5C in a side elevation view, top view and front view, respectively. As shown therein, cutter element insert 260 includes a base portion 261 and a cutting portion 262 that intersect at plane of intersection 264. Axis 268 extends through the center of base 261. Base 261 is generally cylindrical having diameter 265 and an outer surface 266 that defines the outer profile or footprint 267 (FIG. 5B).

Referring to FIGS. 5A and 5B, cutting portion 262 includes a cutting surface 263 that preferably is continually contoured and crestless. Cutting surface 263 generally includes a front or leading surface 270, a trailing or back surface 271, and a pair of flanking surfaces 272, 273 which extend from base 261 and converge to form cutting tip 274. The forwardmost portion of the cutting tip 274 includes nose 275.

As best shown in FIG. 5A, the side profile 281 of cutting surface 263 is generally wedge shaped and canted relative to central axis 268. Side profile 281 includes a front edge 269 formed by front surface 270. Adjacent to intersection 264, front edge 269 is generally straight and angled away from base 261 and away from central axis 268 at an angle shown generally as 295. Side profile 281 is defined, in part, by back surface 271 that slopes from nose 275 toward base 261. Side profile 281 includes a radiused segment 282 having radius $R_1$ at the nose 275 which is blended with a middle segment 283 having radius $R_2$ that is substantially larger than radius $R_1$. Side profile 281 further includes a trailing segment 284 having a radius $R_3$ that is less than $R_2$, but greater than $R_1$.

Referring to FIGS. 5A and 5B, cutting surface 263 extends beyond the outer profile or footprint 267 by an extension length E, shown in FIG. 5A. With cutting portion 263 extending beyond the footprint of base 261, cutting portion 262 is generally described as having a "negative draft" with respect to the base 261. Such cutter element may be manufactured by a conventional process such as injection molding, machining or other suitable processes. U.S. Pat. No. 6,241,034, describing one such method for forming cutter elements having negative drafts is hereby incorporated by reference.

Referring now to FIG. 5B, back surface 271 of cutting surface 263 defines a generally wedge-shaped top cutting profile represented by dashed line 276. Top cutting profile 276 includes a radiused nose portion 277 having radius R. Top profile 276 and cutting surface 263 are bisected by and symmetrical about plane of symmetry 299. Top profile 276 includes its widest dimension 292 as defined by the outermost reaches of lobes 280. Nose 275 is preferably formed with a spherical radius R such that the width 291 of nose 275 is generally defined as 2 times R and such that $R=R_1$. The width of top profile 276 is greatest adjacent lobes 280. Preferably, width 292 is at least three times the width of 291.

As best shown in FIG. 5C, cutting surface 263 defines a front profile 286. Front profile 286 includes an outwardly bowed segment 287 having a generally constant radius, followed by segment 288 having an inverted radius. To allow for deeper penetration of cutter element 260, flanking surfaces 272, 273 include concave regions or recesses 285 that extend from near base 261 toward nose 275 at an angle directed generally away from axis 268. Recesses 285 effectively narrow or sharpen the cutting profile of front surface 270. For particular applications, cutting surface 263 may have recesses 285 formed on only one flanking surface 272, 273, making the cutting surface asymmetrical.

Like cutter element 60 and 160 previously described, cutter insert 260 is intended to remove formation material at a faster rate than conventional inserts, such as a conical or standard chisel. In comparison to the insert 60 and 160, it is believed that insert 260 will have general application in the softer formations of the types drilled with TCI bits.

Figure 6:
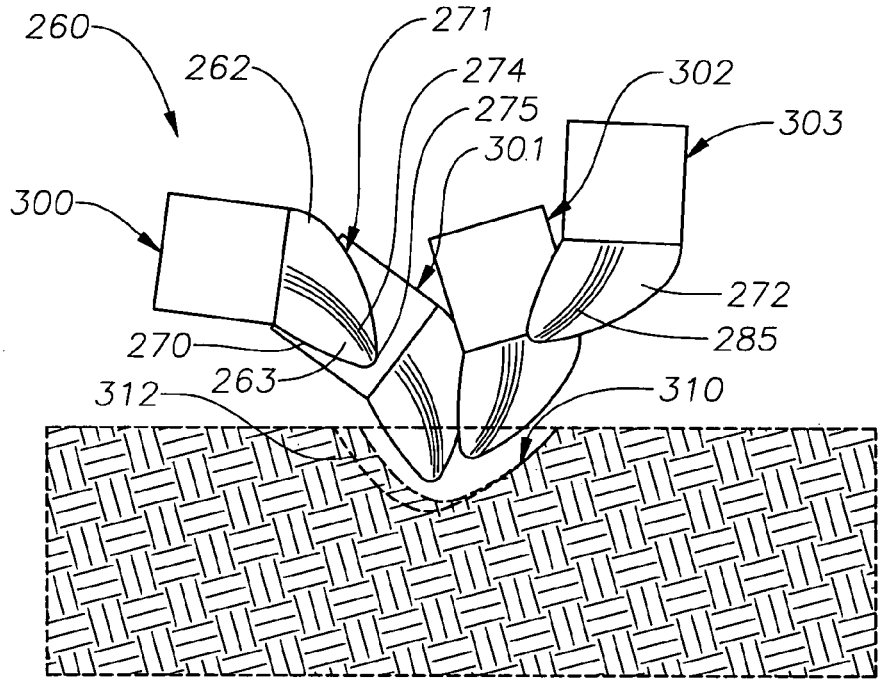
FIG. 6 is a diagrammatic view showing the impact on the formation material of the cutter element of FIGS. 5A–5C when employed in an inner row of the drill bit of FIGS. 1 and 2.

The cutting action and enhancements provided by the embodiments described above are best understood with reference to FIGS. 6 and 7. Referring first to FIG. 6, the cutting path of insert 260 previously described is shown diagrammatically in a partial sectional view. In this figure, insert 260 is employed in an inner row of cutter elements in a rolling cone cutter, such as row 56*a* shown in FIGS. 1 and 2. In FIG. 6, cutter element 260 is shown approaching the formation material from the left and leaving the formation to the right. In its first approach, generally identified as position 300, it can be seen that cutting tip 274 approaches the formation material nose first, so that the sharpest portion of cutting surface 263 is the first to engage the formation material. As shown in position 301, the cutting surface 263 penetrates the formation material to an extent dependant upon the weight on bit, the condition of the insert, and properties of the formation material. In any event, by first presenting to the formation the nose 275 and sharper leading surface 270 (relative to back surface 271), the cutting portion 262 extends deeply into the formation material to a substantial depth.

As the rolling cone cutter moves along the borehole bottom, other cutter elements in other rows come into contact with the formation before insert 260 leaves engagement with the formation. These other cutter elements on other rows form a pivot for the rest of the bit. The pivot causes the cone and insert 260 to scrape laterally on the hole bottom (to the left, as viewed in FIG. 6). Since the cutting portion 262 of insert 260 is crestless and sharper relative to conventional conical inserts having the same diameter base, for example, insert 260 will penetrate deeper into the formation before causing formation fracture. By penetrating deeper into the formation before causing fracture, it is believed that the volume of displaced formation material will be larger than otherwise. In addition, cutting portion 262 of insert 260 will pivot or twist as it moves to position 302. In so doing, the broad trailing surface 271 is pressed against the rear portion 310 of the crater formed by cutting portion 262 and provides leverage so as to enable cutting tip 274 and nose 275 to pry and work against a portion of the formation material that would not otherwise be affected by a conventional conical insert, that portion of the formation being shown in phantom by line 312.

In formations susceptible to brittle fractures, a relatively large volume of material may thus be removed by a single hit or engagement of the formation by wedge-shaped cutter 260. The sharpness of insert cutting surface 263, provided by both its wedge-shaped top and side profiles and by recesses 285 in flanking surfaces 272, 273 supplies additional leverage for removing formation material. As the cone cutter 34 continues its cutting trajectory in the borehole, cutter element 260 becomes disengaged from the formation and moves to the position shown by reference numeral 303.

Figure 7:
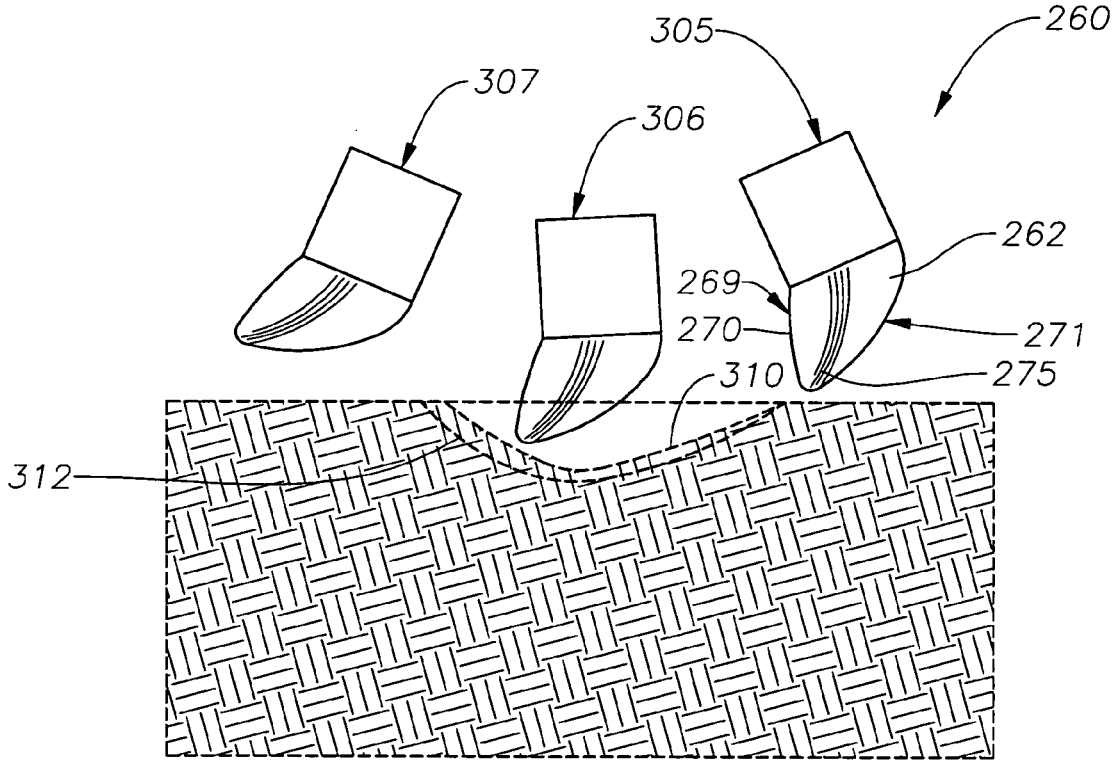
FIG. 7 is a diagrammatic view showing the impact on the formation material of the cutter element of FIGS. 5A–5C when employed in a gage row of the drill bit of FIGS. 1 and 2.

The cutting element described herein may likewise be employed in gage rows or near gage rows in a rolling cone cutter where the cutter elements are employed to engage in a partial reaming function. In that position, the cutter elements may be thought of as approaching the formation material at a shallower angle; however, the wedge-shaped profile provided by the cutter elements described herein is believed to provide advantages. As shown in FIG. 7, as cutter element 260 approaches the formation material at position 305 on the right of the figure, it is positioned to engage the formation first with its sharpest cutting portion, forward edge 269 of front surface 270 and nose portion 275. As the cutting portion 262 moves right to left as viewed in FIG. 7, it engages the formation material at position 306. As the cone cutter further rotates, the wider rear surface 271 enhances the material fracture by allowing the cutter element 260 to travel further into the formation before fracturing the rock. Again, dashed line 312 represents the portion of the formation removed by the action of wedge-shaped cutting profiles of cutter element 260, as compared to the swath removed by a conventional conical insert (represented by dashed line 310), for example. Cutter element 260, after disengaging the formation, moves to position shown by reference numeral 307.

While cutter elements 60, 160, 260 have been shown and described to this juncture as being an insert type cutter element for use in a TCI bit, the cutter elements may likewise be employed as a tooth formed in a cone cutter in a steel tooth bit. Thus, the principles described above for an insert-type bit may likewise be employed and achieved in steel-tooth bits.

Further, while presently preferred embodiments of this invention have been shown and described, modifications thereof can be made by one skilled in the art without departing from the spirit or teaching of this invention. The embodiments described herein are exemplary only and are not limiting. Many variations and modifications of the apparatus described herein are possible and are within the scope of the invention. Accordingly, the scope of protection is not limited to the embodiments described herein, but is only limited by the claims which follow, the scope of which shall include all equivalents of the subject matter of the claims.

What is claimed is:

1. A cutter element for a drill bit comprising:

a base portion having a central axis;

a cutting portion extending from said base portion and having a cutting surface terminating in a rounded nose that is spaced apart from said central axis, said cutting surface including a front surface, a back surface, and a pair of flanking surfaces extending from said base and intersecting at said nose;

wherein at least one of said flanking surfaces includes a concave region having an inverted radius that lies in a plane perpendicular to said central axis of said base; and wherein said back surface slopes from said nose to said base portion and is broader adjacent to said base than adjacent to said nose, said back surface forming a wedge-shaped top cutting profile of said cutting surface.

2. The cutter element of claim 1 wherein said cutting surface includes a wedge-shaped side profile.

3. The cutter element of claim 2 wherein each of said flanking surfaces includes a concave region.

4. The cutter element of claim 3 wherein said nose includes a spherical radius R.

5. The cutter element of claim 3 wherein said side profile has a first segment with radius $R_1$ adjacent to said nose, a middle segment with a radius $R_2$ that is greater than $R_1$, and a trailing segment with a radius $R_3$ that is greater than $R_2$.

6. The cutter element of claim 3 wherein said side profile has a first segment with radius $R_1$ adjacent to said nose, a middle segment with a radius $R_2$ that is greater than $R_1$, and a trailing segment with a radius $R_3$ that is greater than $R_1$ and less than $R_2$.

7. The cutter element of claim 2 wherein said concave region has an elongate shape extending generally in a direction toward said nose.

8. The cutter element of claim 2 wherein said back surface is symmetrical about a plane of symmetry that bisects said back surface, the intersection of said plane of symmetry and said back surface defining a crown line, and wherein said back surface is continuously contoured from said crown line to the intersection of said back surface and said flanking surfaces.

9. The cutter element of claim 8 wherein said back surface is continuously contoured from said nose to said base.

10. The cutter element of claim 1 wherein said base portion includes an outer surface defining the outer profile of said base, and wherein nose is set back from said outer profile by a distance D.

11. The cutter element of claim 10 wherein said nose includes a spherical radius R, and wherein said distance D is at least equal to said radius R.

12. The cutter element of claim 1 wherein said top profile is pear-shaped.

13. The cutter element of claim 1 wherein said top profile has a generally triangular shape.

14. The cutter element of claim 1 wherein said base portion includes an outer surface defining the outer profile of said base, and wherein said nose extends beyond said outer profile by an extension length E.

15. A cutter element for a drill bit comprising:

a base portion having a central axis;

a cutting portion extending from said base portion and having a cutting surface terminating in a rounded nose that is spaced apart from said central axis, said cutting surface including a wedge-shaped side profile and a front surface, a back surface, and a pair of flanking surfaces extending from said base and intersecting at said nose;

wherein at least one of said flanking surfaces includes a concave region;

wherein said back surface slopes from said nose to said base portion and is broader adjacent to said base than adjacent to said nose, said back surface forming a wedge-shaped top cutting profile of said cutting surface; and wherein said top cutting profile has a first segment with radius R adjacent to said nose, a second segment with a radius $R_B$ that is greater than R, and a third segment $R_A$ having an inverted radius, said third segment being positioned at a location that is between said first and second segments.

16. The cutter element of claim 15 wherein said cutting surface includes a side profile having a first segment with radius $R_1$ adjacent to said nose, a middle segment with a radius $R_2$, and a trailing segment with a radius $R_3$ wherein $R_2$ and $R_3$ are greater than $R_1$ and wherein $R_2$ does not equal $R_3$.

17. The cutter element of claim 16 wherein said top profile has a wedge ratio of at least 5 to 1.

18. A cutter element for a drill bit comprising:

a base portion having a central axis and a cutting portion extending from said base portion, said cutting portion having a cutting surface including a front surface, a back surface, and a pair of flanking surfaces between said front and back surfaces, said front, back, and flanking surfaces converging together to form a nose on said cutting surface;

wherein said nose spaced from said central axis;

wherein at least one of said flanking surfaces includes a region that is concave having an inverted radius that lies in a plane perpendicular to said central axis of said base portion; and wherein said back surface has a leading end at said nose and a trailing end opposite from said nose, said back surface being wider at a location adjacent to said trailing end than at said leading end and being generally wedge-shaped as viewed from above.

19. The cutter element of claim 18 wherein said back surface has a wedge ratio of at least 3 to 1.

20. The cutter element of claim 19 wherein said top cutting profile is generally triangular-shaped.

21. The cutter element of claim 19 wherein said top cutting profile is generally pear-shaped.

22. The cutter element of claim 18 wherein said back surface slopes away from said nose toward said trailing end, said cutting surface having a generally wedge-shaped side profile.

23. The cutter element of claim 22 wherein said cutting surface is symmetrical about a plane of symmetry that bisects said back surface, the intersection of said plane of symmetry and said back surface defining a crown line, wherein said back surface slopes down and away from said crown line as said back surface extends between said crown line and the intersection of said back and said flanking surfaces.

24. The cutter element of claim 22 wherein said base portion includes an outer surface defining the outer profile of said base, and wherein said nose is set back from said outer profile of a distance D.

25. The cutter element of claim 22 wherein said base portion includes an outer surface defining the outer profile of said base, and wherein said nose extends beyond said outer profile by an extension length E.

26. A cutter element for a drill bit comprising:

a base portion having a central axis and a cutting portion extending from said base portion, said cutting portion having a cutting surface including a front surface, a back surface, and a pair of flanking surfaces between said front and back surfaces, said front, back, and flanking surfaces converging together to form a nose on said cutting surface;

wherein said nose is spaced from said central axis;

wherein at least one of said flanking surfaces includes a region that is concave; and wherein said back surface has a leading end at said nose and a trailing end opposite from said nose, said back surface being wider at a location adjacent to said trailing end than at said leading end and being generally wedge-shaped as viewed from above; and wherein said cutter element includes a top cutting profile having a first segment with radius R adjacent to said nose, a second segment with a radius $R_B$ that is greater than R, and a third segment $R_A$ having an inverted radius, said third segment being positioned at a location that is between said first and second segments.

27. The cutter element of claim 26 wherein said top cutting profile has a wedge ratio of 5 to 1 or greater.

28. The cutter element of claim 26 wherein said cutting surface includes a side profile having a first segment with radius $R_1$ adjacent to said nose, a middle segment with a radius $R_2$, and a trailing segment with a radius $R_3$ wherein $R_2$ and $R_3$ are greater than $R_1$ and wherein $R_2$ does not equal $R_3$.

29. A drill bit having a nominal gage diameter for drilling a borehole in earthen formations, said bit comprising:

a bit body having a bit axis;

at least one rolling cone cutter rotatably mounted on said bit body and having a plurality of cutter elements disposed in spaced-apart circumferential rows;

a gage row of cutter elements having cutting portions extending to full gage diameter for cutting the corner of the borehole;

an inner row of cutter elements disposed radially inboard of said gage row for cutting the borehole bottom, said inner row cutter elements having a base with a central axis retained in said cone cutter, and a cutting portion extending from said base;

wherein a plurality of said inner row cutter elements have a cutting surface that includes a front surface, a back surface, and a pair of flanking surfaces between said front and back surfaces, said front, back, and flanking surfaces converging together to form a nose on the cutting tip of said cutting surface;

wherein said nose of said cutting surface and is spaced from said central axis, and wherein at least one of said flanking surfaces includes a region that is concave having an inverted radius that lies in a plane perpendicular to said central axis of said base portion; and wherein said back surface has leading end at said nose and a trailing end opposite from said nose, said back surface being wider at a location adjacent to said trailing end than at said leading end and being generally wedge-shaped as viewed from above looking along said central axis.

30. The drill bit of claim 29 wherein said back surface is at least three times wider at a location adjacent to said trailing end than it is at said leading end.

31. The drill bit of claim 30 wherein each of said flanking surfaces includes a region that is concave, and wherein said nose includes a spherical radius.

32. The drill bit of claim 31 wherein said plurality of inner row cutter elements are positioned in said cone cutter such that said front surface of said cutting surface engages the formation material before said back surface.

33. The drill bit of claim 31 wherein said concave regions are elongate and extend generally from the cutter element base toward said nose and away from said central axis of said cutter element base.

34. The drill bit of claim 30 wherein the intersection of said back surface with said front and flanking surfaces forms a top cutting profile of said cutting surface that is generally triangular-shaped.

35. The drill bit of claim 30 wherein the intersection of said back surface with said front and flanking surfaces forms a top cutting profile of said cutting surface that is generally pear-shaped.

36. The cutter element of claim 29 wherein said cutting surface is crestless.

* * * * *